United States Patent [19]

Ventimiglia et al.

[11] Patent Number: 4,534,391

[45] Date of Patent: Aug. 13, 1985

[54] BEVERAGE INSULATOR WITH ADVERTISING PANEL

[75] Inventors: Joseph J. Ventimiglia, St. Louis; Lawrence R. Diener, Fenton, both of Mo.

[73] Assignee: Sinclair & Rush, Inc., St. Louis, Mo.

[21] Appl. No.: 560,733

[22] Filed: Dec. 12, 1983

[51] Int. Cl.[3] ..... B65D 23/08; G09F 3/00

[52] U.S. Cl. ..... 150/52 R; 40/306; 40/324; 220/85 H

[58] Field of Search ..... 220/408, 85 H; 206/519; 150/52 R; 215/13 R; 40/306, 324

[56] References Cited

U.S. PATENT DOCUMENTS

| | | | |
|---|---|---|---|
| 973,085 | 10/1910 | Strause | 220/85 H |
| 1,466,840 | 9/1923 | Kucera | 40/324 |
| 2,412,178 | 12/1946 | Seigh | 206/519 |
| 3,094,240 | 6/1963 | Wanderer | 206/519 |
| 3,257,025 | 6/1966 | Jolly | 220/90.2 |
| 3,813,801 | 6/1974 | Schaaf | 150/52 R |
| 4,263,734 | 4/1981 | Bradshaw | 40/324 |

*Primary Examiner*—George E. Lowrance

*Attorney, Agent, or Firm*—Gravely, Lieder & Woodruff

[57] ABSTRACT

A one-piece plastic insulated beverage receptacle holder having longitudinal side panels, one of which is wider than the remainder and recessed to accommodate ad copy or the like.

1 Claim, 6 Drawing Figures

BEVERAGE INSULATOR WITH ADVERTISING PANEL

BACKGROUND OF THE INVENTION

This invention relates to a combination hand held beverage receptacle insulator and coaster having an enlarged panel on an outer wall of the insulator where advertising material in the form of a company logo, trademark or the like can be imprinted.

The present insulator is formed of a vinyl plastic and has spaced interior ribs, an enclosed bottom wtih a central opening and a reduced neck so that a beverage can, beer, soda, etc., can be accommodated in the insulator. The exterior has spaced grooves corresponding to the interior ribs and has an enlarged recessed panel defined by two ribs on the vertical sides and convex borders on the top and bottom.

One of the principal objects of the present invention is to provide a one-piece hand held polymeric insulator for a beverage receptacle which provides means for spacing the receptacle from the interior of the holder so as to provide an insulating layer of air between the receptacle and the holder.

Another principal object of the present invention is to provide hand held insulating holder for a beverage receptacle which holder has a wide recessed outer panel onto which advertising material and the like can be imprinted.

These and other objects and advantages will become apparent hereinafter.

The present invention comprises a hand held insulating holder for beverage cans and the like which has the interior wall spaced from the beverage can, while still positioning the can securely within the holder, and which has a recessed outer panel for receiving advertising imprints and the like.

In the drawings, where like numbers refer to like parts wherever they occur.

DETAILED DESCRIPTION

Figure 1:
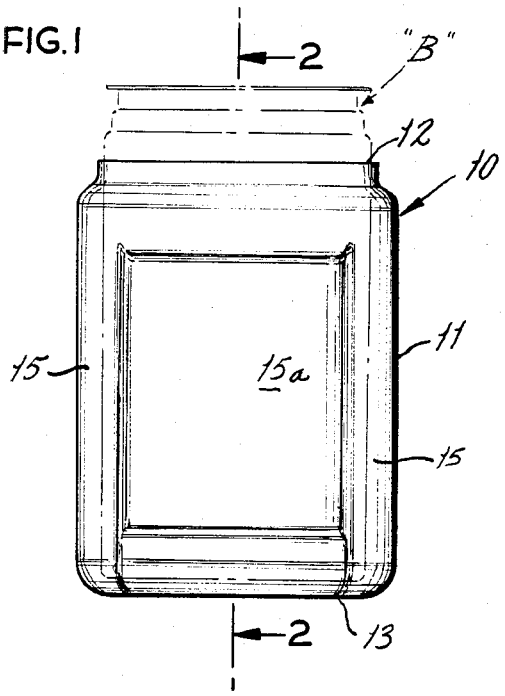
FIG. 1 is a front elevational view of the insulating holder of this invention with a beverage container positioned therein shown in broken lines.

FIG. 1 shows the insulating receptacle 10 which is made of a vinyl polymer or other suitable polymeric material by any suitable conventional molding technique. The unitary one-piece receptacle or holder 10 is designed to hold a beverage container "B" which can be a can, such as a can of beer, soda, etc., or other container.

The holder 10 as formed has a generally cylindrical shaped body 11 with a reduced top opening 12 and a closed bottom wall 13 having a central opening 14 therein.

Figure 2:
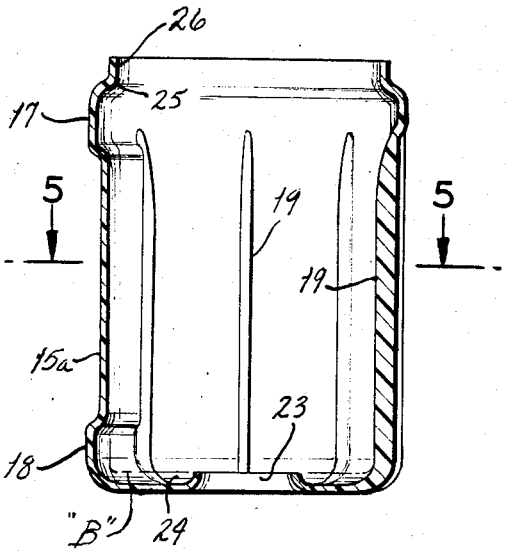
FIG. 2 is a vertical sectional view taken along lines 2—2 of FIG. 1.
Figure 3:
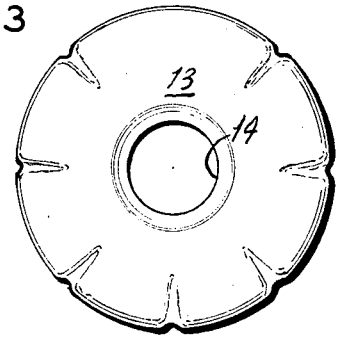
FIG. 3 is a bottom view of the holder.
Figure 6:
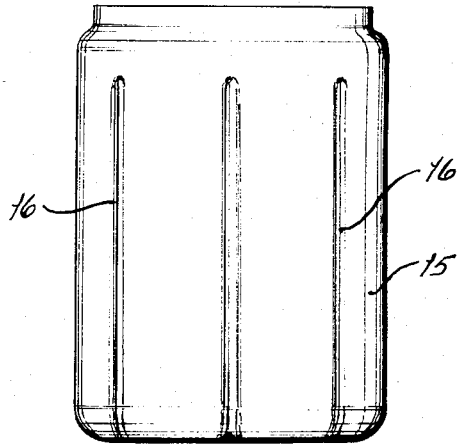
FIG. 6 is a back elevational view showing the rear side of the beverage container shown in FIG. 1.

The cylindrical side wall 11 is divided into seven (7) vertical segments 15 and 15*a* each defined by a longitudinal groove or indentation 16 (FIGS. 1 and 6). Six of the panels 15 are contiguous (FIG. 6) and the seventh panel 15*a*, which separates the ends of the series of contiguous panels 15, is twice the width of a panel 15 (FIGS. 1 and 2) and is recessed so as to define a rectangular space which is adapted to receive and copy or other printed material. The panel 15*a* is further defined by a curved top ridge 17 and a curved bottom ridge 18. This is shown more clearly in FIG. 2.

Figure 4:
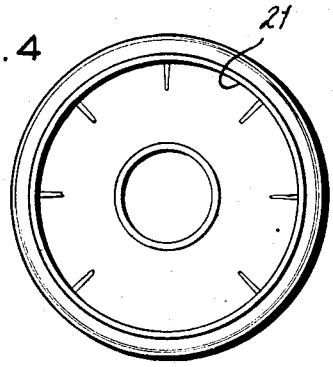
FIG. 4 is a top plan view of the holder.
Figure 5:
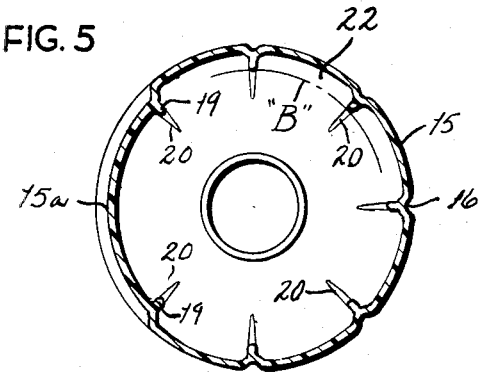
FIG. 5 is a horizontal sectional view taken along lines 5—5 of FIG. 2.

The inside of the cylindrical body 11 includes seven (7) internal strengthening and spacing ribs 19 aligned with and opposed to the grooves 16 in the exterior wall. The ribs 19 extend toward the centerline of the holder 10 and are of truncated pyramidal shape in cross section (FIG. 5) with the thicker section adjacent to the interior wall. The ribs 19 taper toward the wall at the top and alternate ribs 19 have feet 20 along the bottom wall 13. The feet 20 have a strengthening effect on the bottom wall 13. The interior edges of the ribs 19 define an opening of generally the same diameter as the top opening 21 (FIG. 4) and also of about the size of the outside diameter of a typical beverage can "B". Thus, the ribs 19 center the beverage can "B" in the holder 10 and keep the fingers of the user from pushing the side wall 11 into direct engagement with the side wall of the beverage can "B". The ribs 19 serve as a guide to insure square placement of the can "B" in the holder 10 and act to space the can "B" from the side wall 11. The ribs 19 also define with the bottom wall 13 and the can "B" an air space 22 in which air is trapped to act as an insulator for the can "B". Tops of each air space 22 are sealed by the engagement of the top opening 21 with the can "B".

The inside bottom wall 13 has a central opening 14 to allow air to escape when a can "B" is slid into the holder 10. The opening 14 is defined by an upraised interior rim 23, which will seat against the bottom of a flat bottomed can to seal the bottoms of the air spaces 22 and also provide an insulating air space 24 (FIG. 2) at the bottom of the holder. This air space 24 also will trap condensate from the can "B" to prevent it from dripping onto the surface on which the holder is placed.

The reduced top 12 of the holder 10 has a curved shoulder 25 and an upstanding lip 26 which is sized to slidingly accommodate a beverage can "B". The lip 26 frictionally retains the beverage can "B" in the holder to prevent it inadvertently sliding out or bouncing around and possibly spilling.

While the invention has been described in connection with a preferred embodiment, it is not intended to limit the scope of the invention to the particular form set forth, but it is intended to cover such alternatives, modifications and equivalents as may be included within the spirit and scope of the invention as defined by the appended claims.

What is claimed is:

1. A hand held beverage receptacle insulator formed from a unitary polymeric material comprising a cylindrical side wall defined by longitudinal panels, several of which are contiguous, of equal width and have the same outside diameter, and the last of which is wider than the others and is recessed to accommodate imprinting and the like, parallel shoulders of the same plane as the side wall circumference protecting the top and bottom edges of the said last panel, the panels being formed by longitudinal grooves, and the inside of the side wall having inwardly extending ribs aligned with the grooves and extending toward the centerline of the holder to strengthen the side wall and engage the beverage receptacle, the inner edges of the ribs defining a cylindrical opening of approximately the same size as the top opening, a bottom wall formed with a central opening surrounded by a raised internal lip, and a reduced top opening sized to snuggly accommodate a beverage receptacle.

* * * * *